US006752164B1

(12) United States Patent
Park

(10) Patent No.: US 6,752,164 B1
(45) Date of Patent: Jun. 22, 2004

(54) ROOM TENT

(76) Inventor: Wan Joo Park, 3673 Jasmine Cir., San Jose, CA (US) 95135

( * ) Notice: Subject to any disclaimer, the term of this patent is extended or adjusted under 35 U.S.C. 154(b) by 0 days.

(21) Appl. No.: 10/223,105

(22) Filed: Aug. 16, 2002

(51) Int. Cl.[7] ..... E04H 15/36; E04H 9/00

(52) U.S. Cl. ..... 135/136; 135/90; 135/96; 135/124; 446/478; 5/414; 52/3

(58) Field of Search ..... 135/124, 136, 135/156, 96, 90; 52/3; 446/478, 471; 5/414

(56) References Cited

U.S. PATENT DOCUMENTS

| | | | | | |
|---|---|---|---|---|---|
| 144,193 | A | | 11/1873 | Elliott | |
| 671,912 | A | | 4/1901 | Woodward | |
| 1,285,766 | A | | 11/1918 | Martin | |
| 2,440,557 | A | | 4/1948 | Power | |
| 3,368,575 | A | | 2/1968 | Besonen | |
| 3,482,585 | A | * | 12/1969 | Overstreet | 135/121 |
| 3,794,054 | A | * | 2/1974 | Watts | 135/98 |
| 3,956,784 | A | | 5/1976 | Vargas | |
| 4,285,354 | A | * | 8/1981 | Beavers | 135/135 |
| 4,354,091 | A | * | 10/1982 | Bain | 219/213 |
| 4,556,391 | A | * | 12/1985 | Tardivel et al. | 446/478 |
| 4,590,956 | A | | 5/1986 | Griesenbeck | |
| 4,664,266 | A | * | 5/1987 | Fausett et al. | 211/87.01 |
| 4,785,837 | A | | 11/1988 | Hansen et al. | |
| 4,852,598 | A | | 8/1989 | Griesenbeck | |
| 5,069,623 | A | * | 12/1991 | Peat | 446/476 |
| 5,072,694 | A | | 12/1991 | Haynes et al. | |
| 5,259,408 | A | | 11/1993 | Guerin | |
| 5,394,897 | A | | 3/1995 | Ritchey et al. | |
| 5,494,066 | A | | 2/1996 | McMahan | |
| 5,638,848 | A | * | 6/1997 | November | 135/90 |
| 5,676,633 | A | * | 10/1997 | August | 600/27 |
| 5,725,426 | A | * | 3/1998 | Alvarez | 454/187 |
| 5,836,330 | A | | 11/1998 | Franklin | |
| 5,930,854 | A | | 8/1999 | O'Neill et al. | |
| 6,109,280 | A | | 8/2000 | Custer | |
| 6,109,282 | A | | 8/2000 | Yoon | |
| 6,167,898 | B1 | * | 1/2001 | Larga et al. | 135/137 |
| 6,209,557 | B1 | | 4/2001 | Zheng | |
| 6,273,114 | B1 | | 8/2001 | Schaefer | |
| 6,317,910 | B1 | | 11/2001 | Wilson | |
| 6,560,095 | B1 | * | 5/2003 | Zheng | 361/683 |

FOREIGN PATENT DOCUMENTS

WO WO 87/06293 * 10/1987

OTHER PUBLICATIONS

US 664,156, 7/1900, Johnson (withdrawn)

* cited by examiner

*Primary Examiner*—Winnie S. Vip
(74) *Attorney, Agent, or Firm*—Michael I. Kroll

(57) ABSTRACT

The invention discloses an indoor tent encompassing the space in a room designed to change the atmosphere of a child's room or play room having preprinted characters and the ability whereby users can create interchangeable themes. The room-tent has a zippered access panel functioning as a door that functions from the interior and the exterior. A window is provided to allow air and sunlight to enter the structure and has attached curtains. An opening is also provided for either a viewing port or access port and can also be provided with curtains. A cargo net is attached to the ceiling portion of the interior of the tent. Objects such as clothes, books, magazines, towels and other goods are stored away and easily access. Hook and loop attachable picture frames are also provided. The frames are designed so that the pictures can be interchangeable with the design of the tent. The picture frames are fixedly attached to the tent wall by means of hook and loop fasteners.

12 Claims, 17 Drawing Sheets

ROOM TENT

BACKGROUND OF THE INVENTION

1. Field of the Invention

The present invention relates generally to tents and, more specifically, to tents that are designed for interior use to change the atmosphere of a child's room or play room.

The motivation for the invention comes from my own feelings extending from childhood of a very comfortable, secure and happy feeling when I go into a tent and now having children of my own and seeing them at home or in the car using a blanket to make a cave and further considering psychological studies that find that men, women and children want to go back to the mothers womb. There is a continual fascination with totally encompassing enclosures such as tents that can be closed to provide an atmosphere of security and comfort.

Therefore it is felt that there is a need to provide this calm and playful feeling of security by providing a new and novel use for tent-like structures by creating a tent-like structure within a home whereby the user can create interchangeable themes with the room-tent.

Furthermore, the concept of bringing the tent into the house is a new concept with special characteristics which can be designed in more ways than one. The room tent is designed for interior activities while tent are primarily designed for outdoor activities. Some of the advantages are as follows.

The invention is not a permanent product while rooms have to be painted or wallpapered, this invention can change the atmosphere can easily be assembled and disassembled.

The room tent installed in a child's room gives the illusion that they are camping and because of the options to have preprinted characters like Snow White, Little Mermaid, Harry Potter, Star Wars, etc, or prints, it would be like being in a different world. The room tent can also be decorated according to the holiday such as stringing Christmas lights on the interior or exterior. Glow in the dark novelties such as stars and planets can be placed on the interior walls for an outdoorish mood.

The design of the tent can be rectangular to encompass the entire room area on an igloo. The present invention can be designed to fit the size of any room.

The room tent can also serve as a spare bedroom when company comes the room tent can be set up in the living room to afford privacy to guests. In large open areas like schools and churches, the room tent can be setup to serve as classrooms or playrooms. Additionally, in the armed forces large tents can be subdivided by a plurality of room tents providing privacy to personnel.

Another advantage of the room-tent is that you can easily change the theme of the room simply by attaching new themes using the provided hook and loop strips to the existing room-tent. It can also be easily assembled and disassembled. Since there is no floor member to the room-tent, wires can be run to the existing wall receptacles. Additionally, it eliminates the need to paint a room to change its appearance and themes can be changed to suit the age group or time of year such as holidays and birthdays.

The room-tent encompasses the entire room floor area and can be constructed in a rectangular shape having tie straps that can be attached to ceiling corner fasteners or dome shaped having a primary tent structure of four walls supported by a tubular framework of interconnecting bungee type tent poles that pass through a plurality of pole pockets located on the exterior portion of the tent structure.

In all cases the room-tent has no floor, which allows for the running of wires from the exterior of the tent to the interior of the room-tent. The interior of the room-tent provides a variety of designs depicting favorite characters, movie themes or other themes. The room-tent is provided in three different choices, one choice is providing characters and pictures on the inside walls, choosing from a variety of characters. Another choice is with hook and loop fasteners and attachable pictures that allow the user to change as frequently as desired. The third choice is a plain, colorful material without any characters or pictures on the inside walls.

A large entrance is provided having a zippered access panel functioning as a door and is accessible from the interior and the exterior. A window is provided to allow air and sunlight to enter the structure and has attached curtains. An opening is also provided for either a viewing port or access port and can also be provided with curtains. A cargo net is attached to the ceiling portion of the interior of the tent. Objects such as clothes, books, magazines, towels and other goods are stored away and easily access. Hook and loop attachable picture frames are also provided. The frames are designed so that the pictures can be interchangeable with the design of the tent. The picture frames are fixedly attached to the tent wall by means of hook and loop fasteners.

As additional elements other options may be added to the interior and exterior structure such as extension tunnels or subdividing the interior of a larger tent with the smaller room-tents.

The new concept of the room-tent and its special characteristics, allows the room-tent to be designed to the custom needs of the user, such as location of windows and portals, designer doors and much more.

Until now, tents have been made primarily for outdoor activities and mainly for sleeping, but the present invention is designed for inside the house and contains the bed, dresser, desk and computer, lamp, etc.

Another advantage of the room-tent is it allows the air conditioning in the summer to flow evenly and not directly out of the vent and hitting the user immediately. This method is healthier than being hit directly by the air conditioning. In the winter the heat flows evenly. It also holds in the heat. The room-tent can also serve as a spare bedroom for guests and can be set up in the living room, giving the guest privacy.

The design for the inside walls varies. The user may choose any character that their children like to completely change the atmosphere of the room-tent and the tent can additionally be provided with the characters preprinted on the interior of the tent walls or fixedly attached to the walls of the tent by the use of hook and loop fasteners.

2. Description of the Prior Art

There are other tents designed for living quarters or cover protection and privacy. Typical of these is U.S. Pat. No. 144,193 issued to Elliott on Nov. 4, 1873.

Another patent was issued to Johnson on Jul. 24, 1900 as U.S. Pat. No. 654,156. Yet another U.S. Pat. No. 671,912 was issued to Woodward on Apr. 9, 1901 and still yet another was issued on Nov. 26, 1918 to Martin as U.S. Pat. No. 1,285,766.

Another patent was issued to Power on Apr. 27, 1948 as U.S. Pat. No. 2,440,557. Yet another U.S. Pat. No. 3,368,575 was issued to Besonen on Feb. 13, 1968 Another was issued to Vargas on May 18, 1976 as U.S. Pat. No. 3,956,784 and still yet another was issued on Nov. 22, 1988 to Hansen et al. as U.S. Pat. No. 4,785,837.

Another patent was issued to Guerin on Nov. 9, 1993 as U.S. Pat. No. 5,259,408. Yet another U.S. Pat. No. 5,394,897 was issued to Ritchey et al. on Mar. 7, 1995 Another was issued to McMahan on Feb. 27, 1996 as U.S. Pat. No. 5,494,066 and still yet another was issued on Nov. 17, 1998 to Franklin as U.S. Pat. No. 5,836,330.

Another was issued to Schaefer on Aug. 14, 2001 as U.S. Pat. No. 6,273,114 and still yet another was issued on Nov. 20, 2001 to Wilson as U.S. Pat. No. 6,317,910.

U.S. Pat. No. 144,193

Inventor: Edson Elliott

Issued: Nov. 4, 1873

This invention relates to wheel carriage covers having collapsing-tackle consisting of lines and pulleys and the supporting and lifting tackle consisting of lines and lifting tackle all arranged and operating simultaneously.

U.S. Pat. No. 654,156

Inventor: Jacob T. Johnson

Issued: Jul. 24, 1900

This invention is a canopy frame or support, the combination of foldable sections adapted to be suspended in a horizontal position exclusively from a point above the same and having hinge connections at their inner terminals which permit the sections to fold upwardly and prevent movement thereof below a horizontal plane when open, the hinge connections having stops for engagement with each other, a transversely-extending rod projecting across the width of the sections and disposed in the same plane as the latter, the opposite extremities of the said rod serving as pintels for pivotally connecting the hinge-sections, the said rod being in central position relatively to the sections, and the sections normally extended from the rod in a longitudinal direction an equal distance.

U.S. Pat. No. 671,912

Inventor: Walter Woodward

Issued: Apr. 9, 1901

This invention is a mosquito-canopy, comprising a frame of detachable members, and a canopy or netting held and supported by two opposite members of the frame and secured thereon by the detachable intermediate members of the frame.

U.S. Pat. No. 1,285,766

Inventor: Paul Martin

Issued: Nov. 26, 1918

This invention is a housing including a top, ends and side ends and sides having weighted members extending respectively therealong at their lower portions, clips secured to their weighted members with their open sides upward to receive between them said sides and ends as said housing is raised, a rope extending longitudinally of the top and above the same, the rope having a pendent portion, a ring to which the lower end of said pendent portion is connected, downwardly diverging ropes connected with the ring and also with the front end weighted member, a second rope. A ring connected with the second rope, downwardly diverging ropes connected with the second ring and also with the rear weighted member, and means for effecting the simultaneous action of the two ropes to raise or lower the housing.

U.S. Pat. No. 2,440,557

Inventor: Clifton Power

Issued: Apr. 27, 1948

This invention relates to a fabric building comprising means providing corner posts, an assemblable roof frame slidable upon said corner posts, means for hoisting the roof frame upwardly on the corner posts and holding it in elevated position thereon, and a tent having a roof and side walls, the tent having means by which its roof may be suspended from said roof frame.

U.S. Pat. No. 3,368,575

Inventor: Ruben Besonen

Issued: Feb. 13, 1968

A portable collapsible shelter comprises a plurality of general inverted l-shaped support frames which are pivotally connected so that they can be folded and unfolded to be radially disposed with respect to the other.

U.S. Pat. No. 3,956,784

Inventor: Joe Vargas

Issued: May 18, 1976

A portable bed canopy adjustable for any size bed and includes four floor mounted support posts which are spring loaded to engage the ceiling for substantially rigid support of the light weight canopy elements.

U.S. Pat. No. 4,785,837

Inventor: Victoria Hansen et al.

Issued: Nov. 22, 1988

An arched body portion is supported by line means to hang from a ceiling over a bed so as to form a canopy independent of the bed. The body portion preferably is constructed of rigid board material having novel joint sections forming the arched configuration.

U.S. Pat. No. 5,259,408

Inventor: Francois Guerin

Issued: Nov. 9, 1993

The invention relates to apparatus for providing protection against insects. The apparatus comprises a support device (10), a framework (20) carried by the support device, and netting carried by the framework for the purpose of surrounding a protected zone. The framework comprises a central pivot (22) about which a plurality of arms are capable of pivoting about practically the same axis, said axis being designed to be substantially vertical. The arms (24, 26) can pivot about said axis between a working position in which they are distributed around the axis and a rest position in which they are all placed on the same side of a vertical plane including the pivot. The invention is applicable to mosquito nets.

U.S. Pat. No. 5,394,897

Inventor: Michael Ritchey et al.

Issued: Mar. 7, 1995

A tent system interconnects any number of stand-alone tents (12) to form a tent network (10). The tents (12) are interconnected through connection modules (14). The tents (12) include at least two and preferably three openings (30) which serve as doorways. Various fasteners attach to the tents (12) near each opening (30). One fastener (54) removably couples to a complimentary fastener (34, 36) on the connection module. Another fastener (72) mates with a complimentary fastener (74) on a door panel (76), and yet another fastener (78) mates with a complimentary fastener (80) on a screen panel (82). The openings (30) are formed in tent panels (26) that slope downward and outward from the top of the tent (12). The connection modules (14) have flexible sheet material (32) sides (38, 40) with ends configured with a downward and inward slope that allows them to mate with the tent panels (26).

U.S. Pat. No. 5,494,066

Inventor: Allan McMahan

Issued: Feb. 27, 1996

A tethered, bridle supported insect proof protective enclosure having top side and end walls composed of insect proof net fabric with the walls having bottom weighting for establishing insect sealed engagement with the ground, floor or other surface on which the apparatus is installed. The top wall is provided with an integrated supporting framework composed of a plurality of jointed support rods having ends thereof received within support pockets attached to the top wall and supported at intermediate portions thereof by means of support rings extending from reinforced support patches that are attached to the top wall. An embodiment may be provided having a floor and being of a single or double bed width and having ingress and egress through closures such as zippers or releasable fastener material that are used at wall openings. The insect proof protective enclosure is intended to be positioned with the walls thereof disposed in significantly spaced relation with the sides and ends of the cot or bed that in located within the enclosure. After installation of the insect proof enclosure its position may be readily changed to suit the needs and comfort of the user without requiring any disassembly for such purpose.

U.S. Pat. No. 5,836,330

Inventor: Linsey Franklin

Issued: Nov. 17, 1998

A canopy assembly available in a wide range of configurations, sizes and decor. The canopy assembly of the present invention consists of several components. These components include an easily fabricated canopy cover. The assembly also includes suspension frame members for forming a suspension frame which is affixed to the canopy cover. Surface mounts are included for insertion into an overhead structure. Suspension line is included to suspend the suspension on frame from the surface mounts.

U.S. Pat. No. 6,273,114

Inventor: Gary Schaefer

Issued: Aug. 14, 2001

A modular tent system that supports a number of detachable, weatherproof, self-supporting living quarter or storage pods. In a wall tent configuration, a primary tent is supported from a tubular framework. Each pod mounts to a covered access port of the primary tent. Each pod includes a separate support framework, sidewalls, floor and roof. Fasteners bordering the peripheral edges of the pod door flap and access port flap interconnect and secure the pod to the walls of the primary tent. Separate fasteners at the pod door flap and access port flap independently control access to the living space of the primary tent.

U.S. Pat. No. 6,317,910

Inventor: Keith Wilson

Issued: Nov. 20, 2001

A suspended bed canopy for suspending a canopy over a bed without supports being attached to and extending from the bed. The suspended bed canopy includes a suspension assembly comprising a plate member and a frame. The plate member has a topside, a bottom side and a peripheral edge extending therebetween. The topside has a plurality of bores therein. The frame generally has a length and width greater than a length and width of the plate member. The frame has an inner surface and an outer surface. A plurality of hanging means is insertable in the bores and removably hangs the plate from the ceiling. A panel is removably coupled to the plate and the frame such that the panel secures the plate to the frame.

While these tents may be suitable for the purposes for which they were designed, they would not be as suitable for the purposes of the present invention, as hereinafter described.

The present invention, a room-tent, is designed for indoor use having a primary tent structure of four walls supported by a tubular framework of interconnecting bungee type tent poles that pass through a plurality of pole pockets located on the exterior portion of the tent structure. The room-tent has no floor, which allows for the running of wires from the exterior of the tent to the interior of the room-tent. The interior of the room-tent structure provides a variety of designs depicting favorite characters, movie themes or other themes. The room-tent is available in three different choices, one choice is providing characters and pictures on the inside walls, choosing from a variety of famous characters. Another choice is with hook and loop fasteners and attachable pictures that allow the user to change as frequently as desired. The third choice is a plain, colorful material without any characters or pictures on the inside walls. A large entrance is provided consisting of a zippered flap accessible from the interior and the exterior. A window is provided to allow air and sunlight to enter the structure and has attached curtains. An opening is also provided for either a viewing port or access port to a closet and is also provided with curtains. A cargo net is suspended from the ceiling portion of the interior of the tent. Objects such as clothes, books, magazines, towels and other goods are stored away and easily access. Hook and loop attachable picture frames are also provided. The frames are designed so that the pictures can be interchangeable with the design of the tent. The picture frames are fixedly attached to the tent wall by means of hook and loop fasteners. Other options may be added to the interior and exterior structure such as extension tunnels or subdividing the interior of a larger tent with the smaller room-tents.

The new concept of the room-tent and its special characteristics, allows the room- tent to be designed to the custom needs of the user, such as location of windows and portals, designer doors and much more.

While tents have been made primarily for outdoor activities and mainly for sleeping, the present invention is designed for interior use and can change the atmosphere of a child's bedroom. It covers the entire room from all four corners of the ceiling to all four corners of the floor including the bed, dresser, desk and computer, lamp, etc. The room-tent can be set up in two different ways, by the provided tent poles or tied to all four corners of the room.

SUMMARY OF THE PRESENT INVENTION

A primary object of the present invention is to provide a room-tent that is designed for indoor use.

Another object of the present invention is to provide a room-tent that is designed for interior use having a tent-like structure suspended by straps fastened to the ceiling corners or supported by a tubular framework of interconnecting bungee type tent poles that pass through a plurality of pole pockets located on the exterior portion of the tent structure.

Yet another object of the present invention is to provide a room-tent where the interior of the room-tent structure provides a variety of designs depicting favorite characters, movie themes or other themes and can be replaced by other themes as frequently as desired to change the mood of the room-tent and are fixedly attached to hook and loop fasteners located within the wall tent.

Still yet another object of the present invention is to provide a room-tent that has a large zippered entrance accessible from the interior and the exterior.

Another object of the present invention is to provide a room-tent that has a window with attached curtains to selectively allow air and sunlight to enter the structure.

Yet another object of the present invention is to provide a room-tent that has an opening for either a viewing port or access port and is also provided with curtains.

Still yet another object of the present invention is to provide a room-tent that has a cargo net attached to the ceiling portion of the interior of the tent.

Additional objects of the present invention will appear as the description proceeds.

The present invention overcomes the shortcomings of the prior art by providing a room-tent designed for indoor use suspended by straps fixedly attached to fasteners positioned in the ceiling corners or having a tubular framework of interconnecting bungee type tent poles passing through a plurality of pole pockets located on the exterior portion of the tent structure. The room-tent has no floor, which allows for the running of wires from the exterior of the tent to the interior of the room-tent. The interior of the room-tent provides a variety of designs depicting favorite characters, movie themes or other themes. It is available in three different choices, one choice is characters and pictures on the inside walls, choosing from a variety of famous characters. Another is with hook and loop fasteners and attachable pictures that allow the user to change as frequently as desired. The third choice is a plain, colorful material without any characters or pictures on the inside walls. A large zippered entrance is provided accessible from the interior and the exterior. A window is provided to allow air and sunlight to enter the structure and is provided with attached curtains. An opening is also provided for either a viewing port or access port and is also provided with curtains. A cargo net is provided and attaches to the ceiling portion of the interior of the tent. Objects such as clothes, books, magazines, towels and other goods are stored away and easily access. Hook and loop attachable picture frames are also provided. The frames are designed so that the pictures can be interchangeable with the design of the tent and are fixedly attached to the tent wall by means of hook and loop fasteners. Other options may be added to the interior and exterior structure such as extension tunnels or subdividing the interior of a larger tent with the smaller room-tents.

The new concept of the room-tent and its special characteristics, allows the room-tent to be designed to the custom needs of the user, such as location of windows and portals, designer doors and much more.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

LIST OF REFERENCE NUMERALS UTILIZED IN THE DRAWINGS

10 room tent
12 room
14 room ceiling
16 room walls
16 room closet
18 room window
22 room entrance
24 room furniture
26 room ceiling fastener
30 fabric
32 tent pole channel
34 tent pole
36 tent pole male connector
38 tent pole female connector
40 tent pole retaining member
42 tent door
44 tent door fastener
46 tent door fastener handle
48 attachabledetachable panel
50 corner strap
52 ceiling strap
54 access portal
56 access portal curtain
58 access portal curtain fasteners
60 room tent window
62 room tent window curtain
64 panel fasteners
66 cargo net
68 cargo net fasteners

70 picture frames
72 picture frame fasteners
74 inflatable wall bed
76 inflatable wall bed access panel
78 inflatable wall bed access panel fasteners
80 inflatable wall bed inflation valve
82 inflatable wall bed deflation valve

BRIEF DESCRIPTION OF THE DRAWING FIGURES

In order that the invention may be more fully understood, it will now be described, by way of example, with reference to the accompanying drawing in which.

Figure 14:
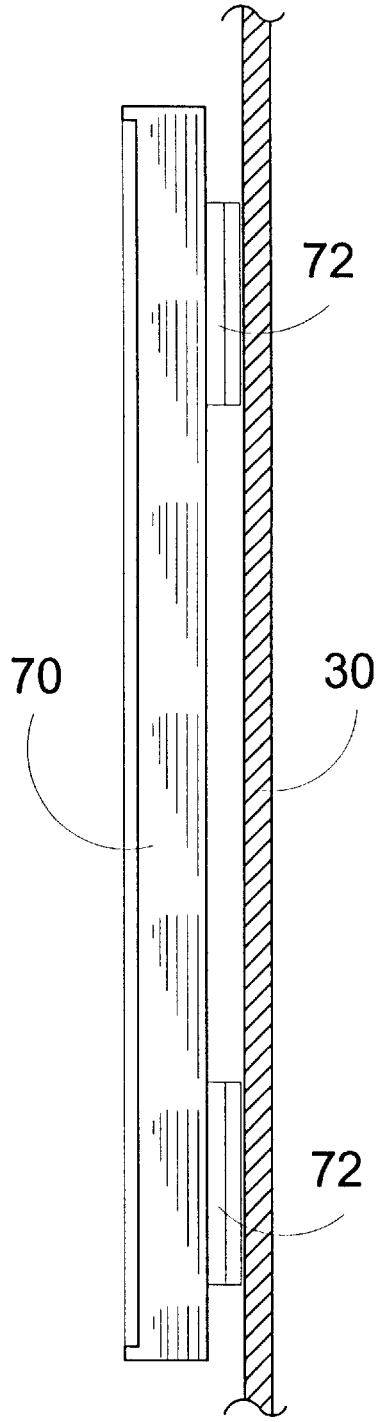

FIG. 14 jide view of a picture frame using the hook and loop fasteners.

Figure 15:
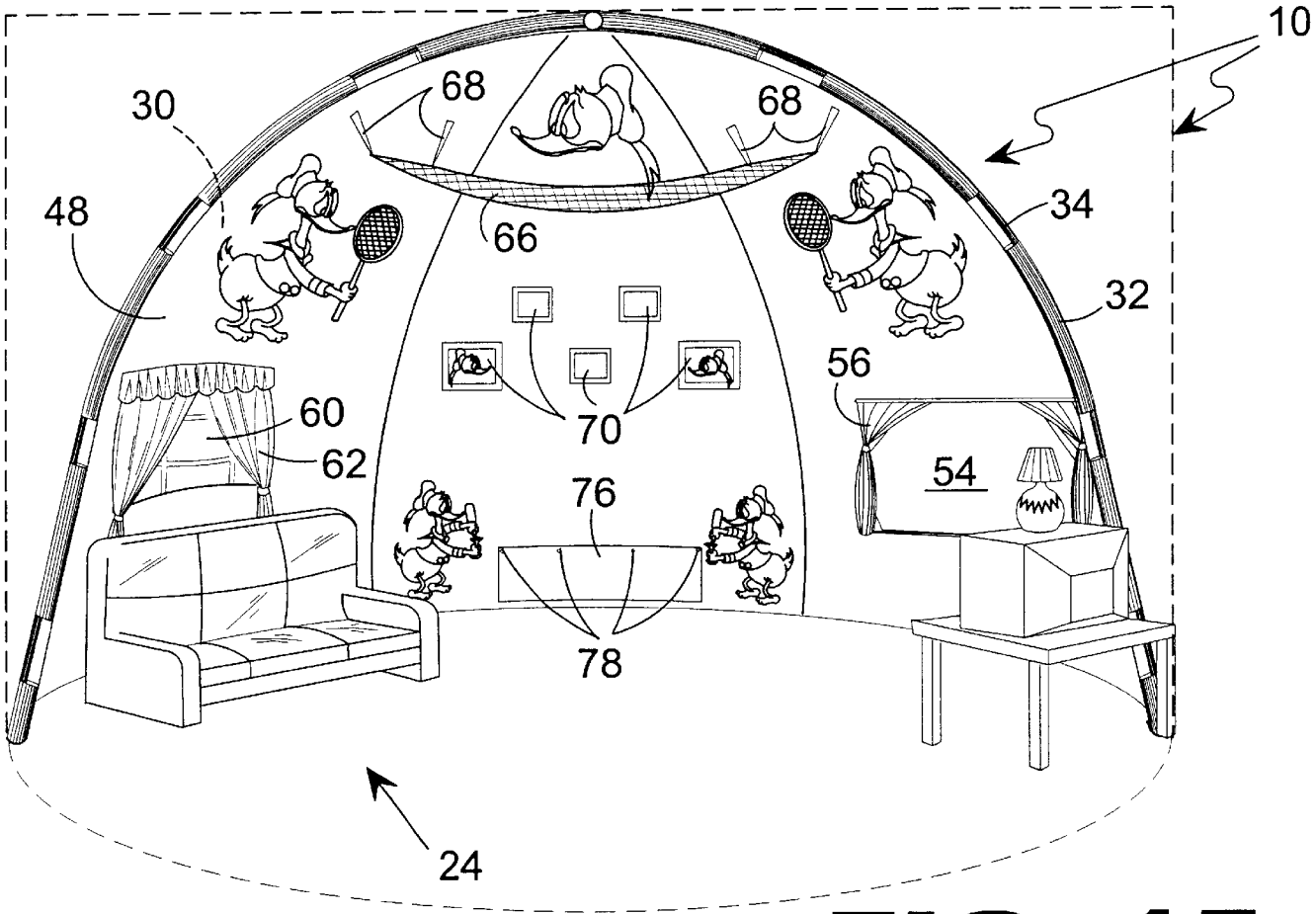

FIG. 15 is an illustrative view of a tent having a single theme with an additional element.

Figure 16:
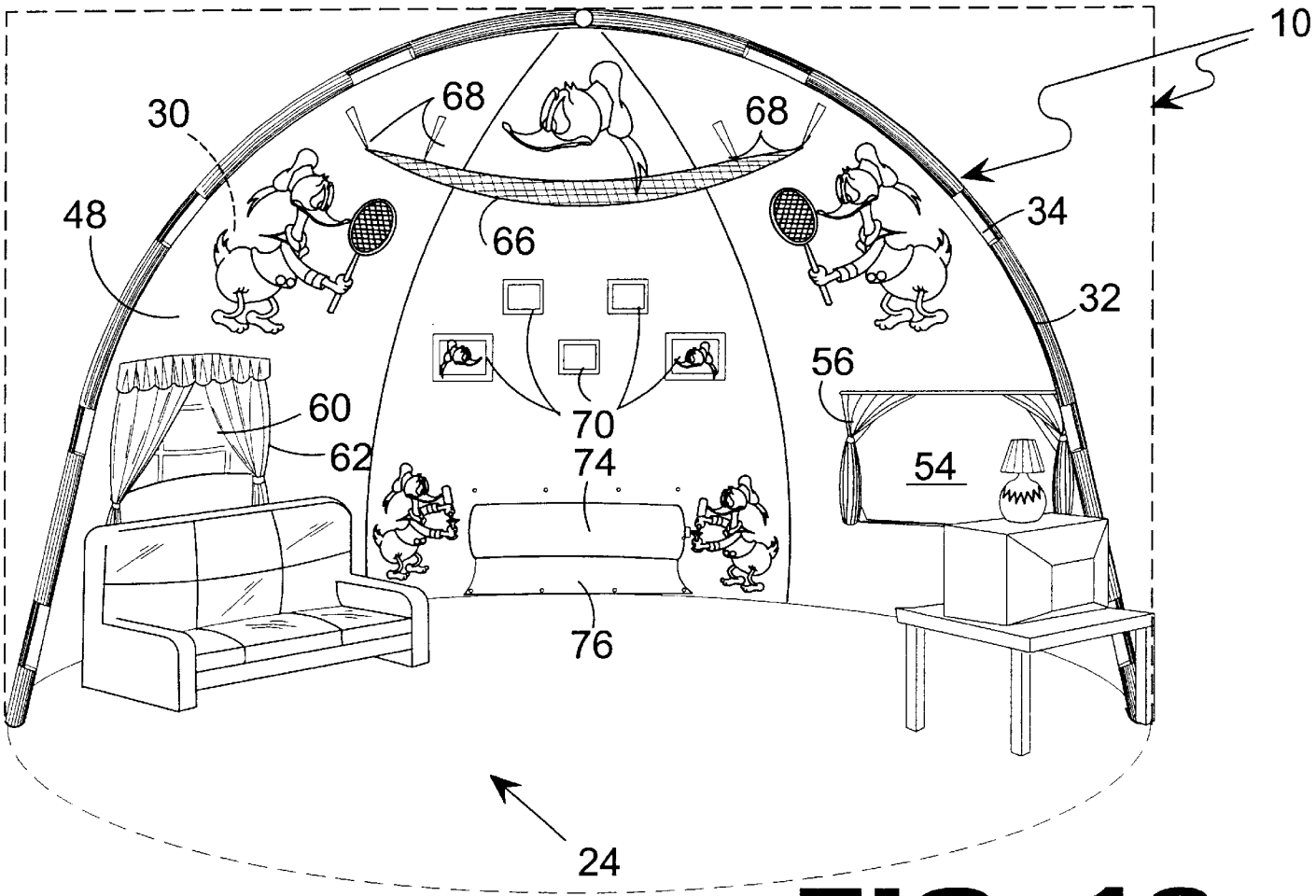

FIG. 16 is an interior view of the present invention having a single theme and additional element.

Figure 17:
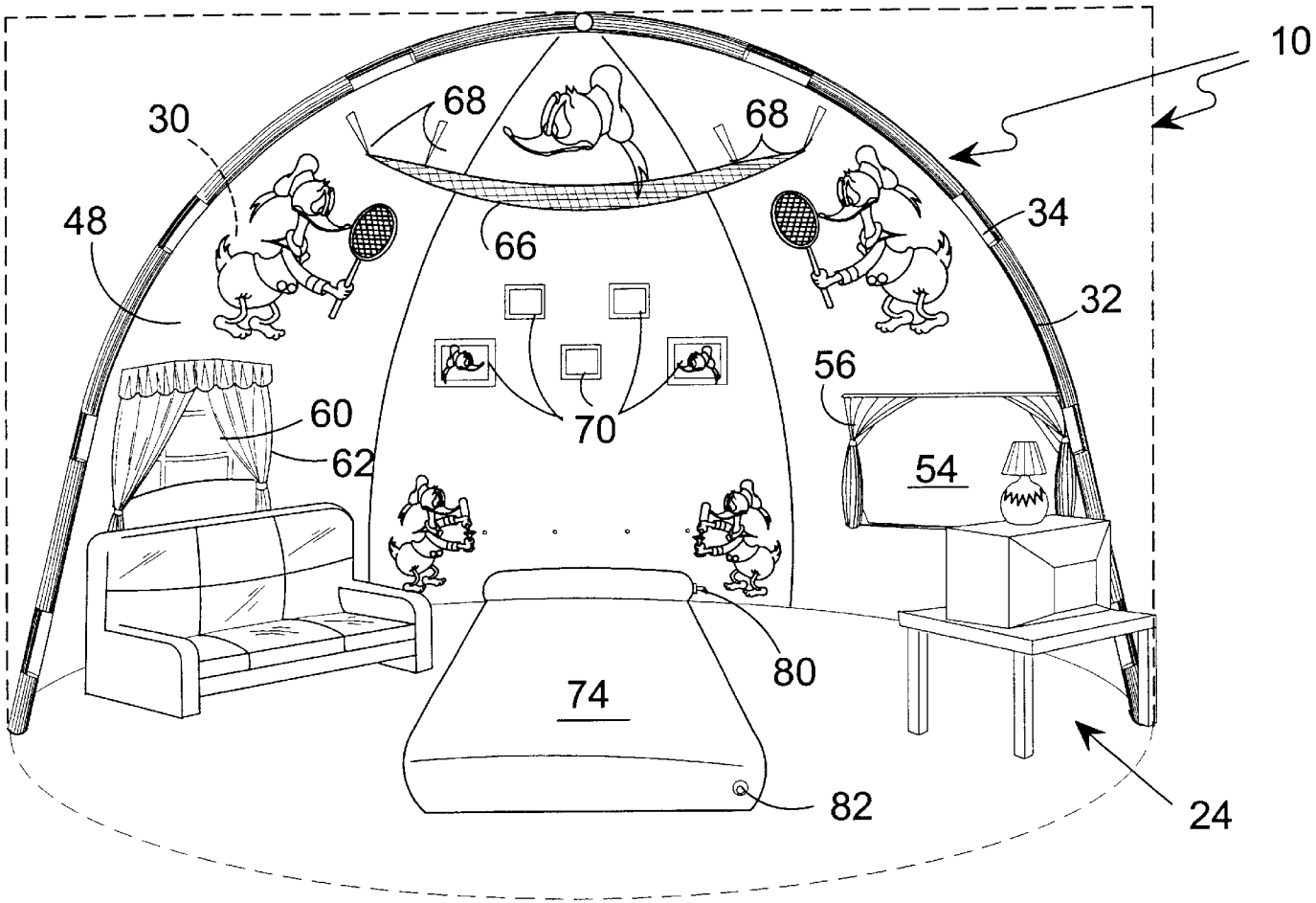

FIG. 17 is an interior view of the present invention having a single theme and an additional element.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
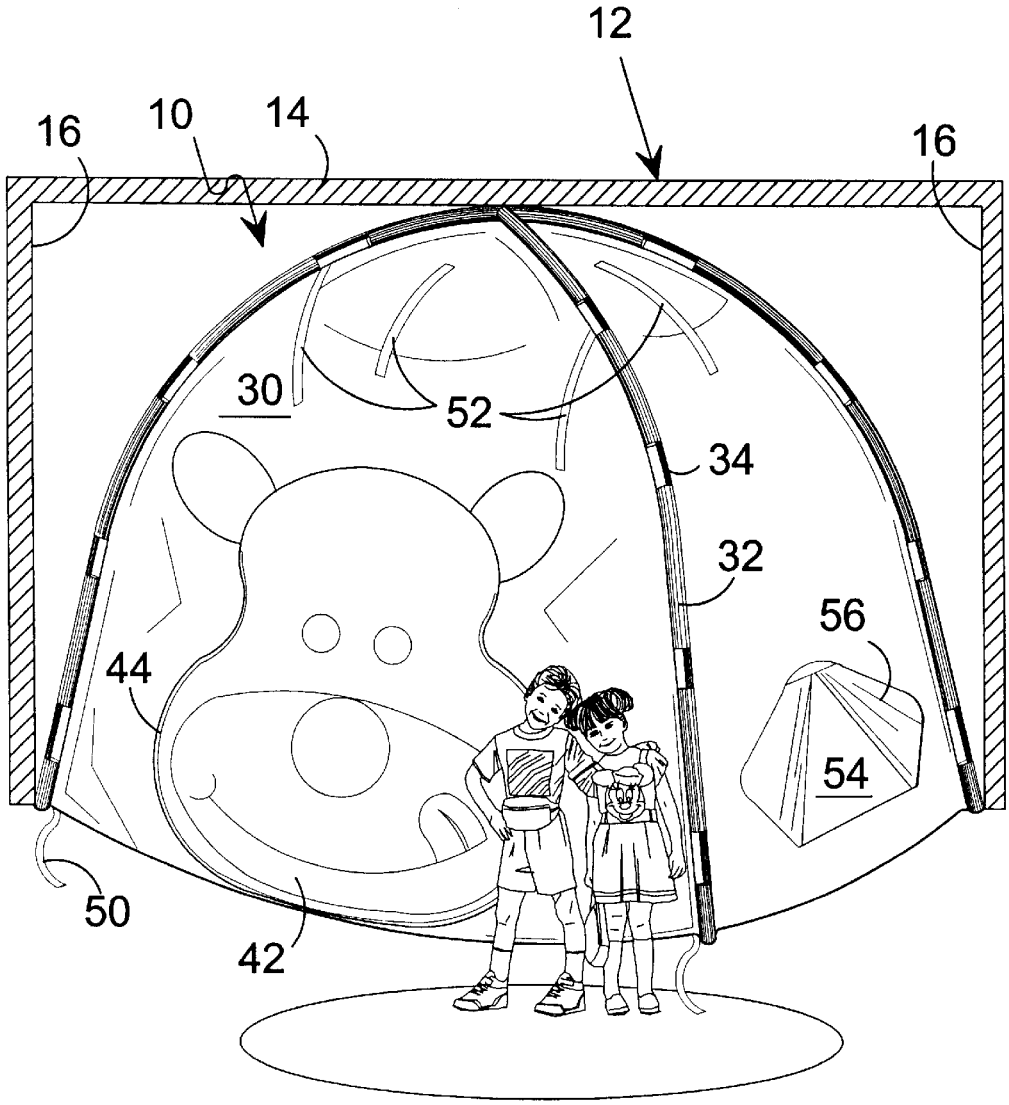
FIG. 1 is an illutrative view of the present invention in use.

Referring to FIG. 1, shown is an illustrative view of the present invention in use. The present invention, a room-tent 10, is designed to be assembled within a room 12 of a house. The primary tent structure 10 is supported by a tubular framework of interconnecting bungee type tent poles 34 that pass through a plurality of pole pockets 32 located on the exterior portion of the tent structure. The room-tent 10 has no floor and allows for electrical wiring to enter the interior of the room-tent 10 from the outside. The interior of the room-tent 10 structure provides a variety of designs depicting a favorite character, movie theme or other themes and are interchangeable as frequently as desired and are attached to the walls of the room tent by means of hook and loop. A large entrance 42 is provided and consists of a right side and a left side zipper 44 that is opened from the bottom center of the door and pulled in an upward direction. The zipper 44 is accessible from the interior and the exterior. A window is provided to allow air and sunlight to enter the structure. An opening 54 is also provided for either a viewing port or access port both are provided with curtains.

Figure 2:
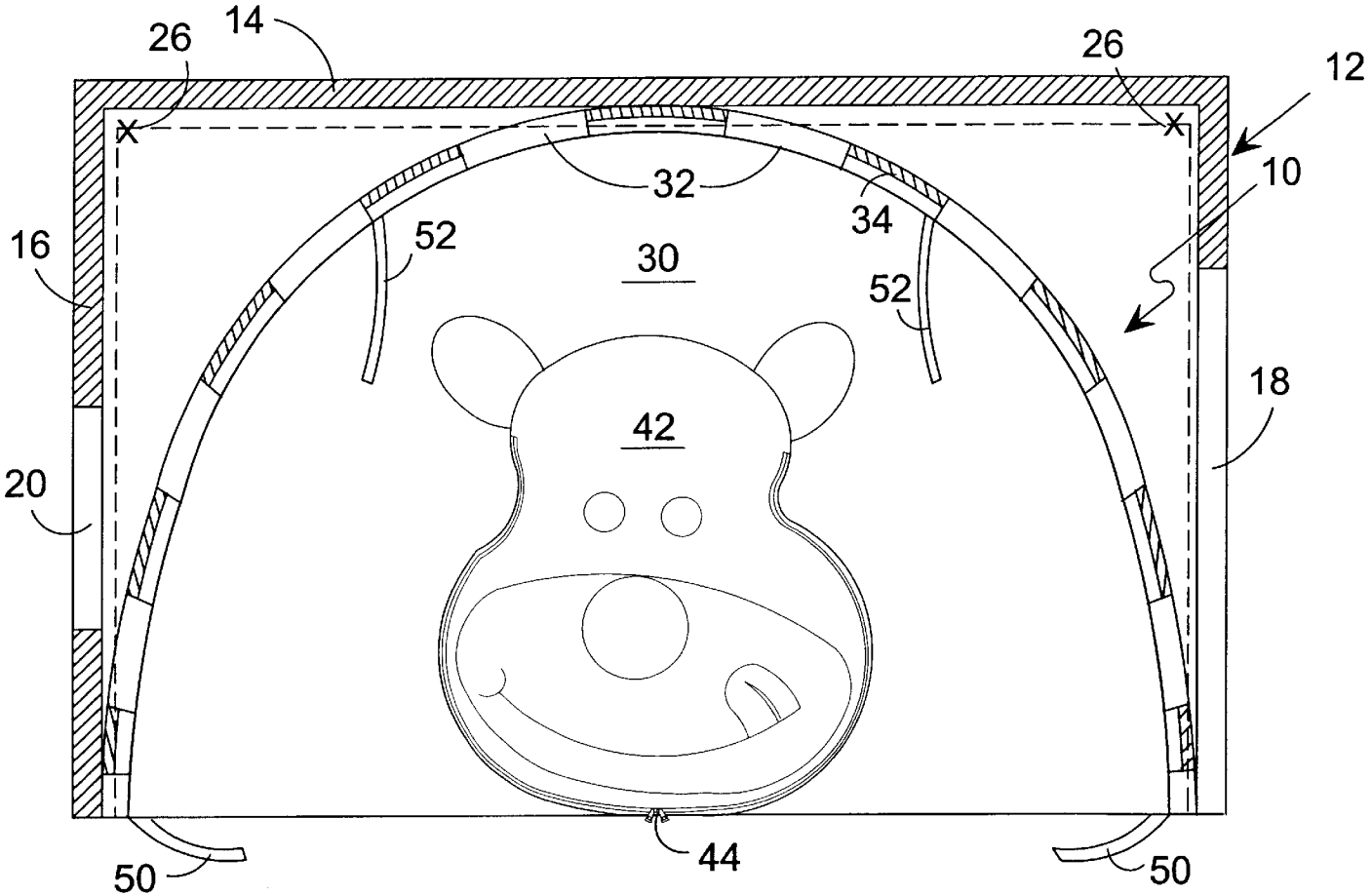
FIG. 2 is a frontal view of the present invention.

Referring to FIG. 2, shown is a frontal view of the present invention. Shown is a frontal view of the room-tent 10 set up within a room 12. The room-tent 10 covers the entire room 12 from all four corners of the ceiling 14 and floor and consists of a four wall tent structure with no floor that can be fastened to fasteners 26 by provided ceiling straps 52. The door portion 42 of the present invention can be designed and provided in a vast variety of shapes and characters. Additionally the room-tent 10 can be a freestanding structure having exteriorly positioned channels 32 with tent poles 34 passing therethrough.

Figure 3:
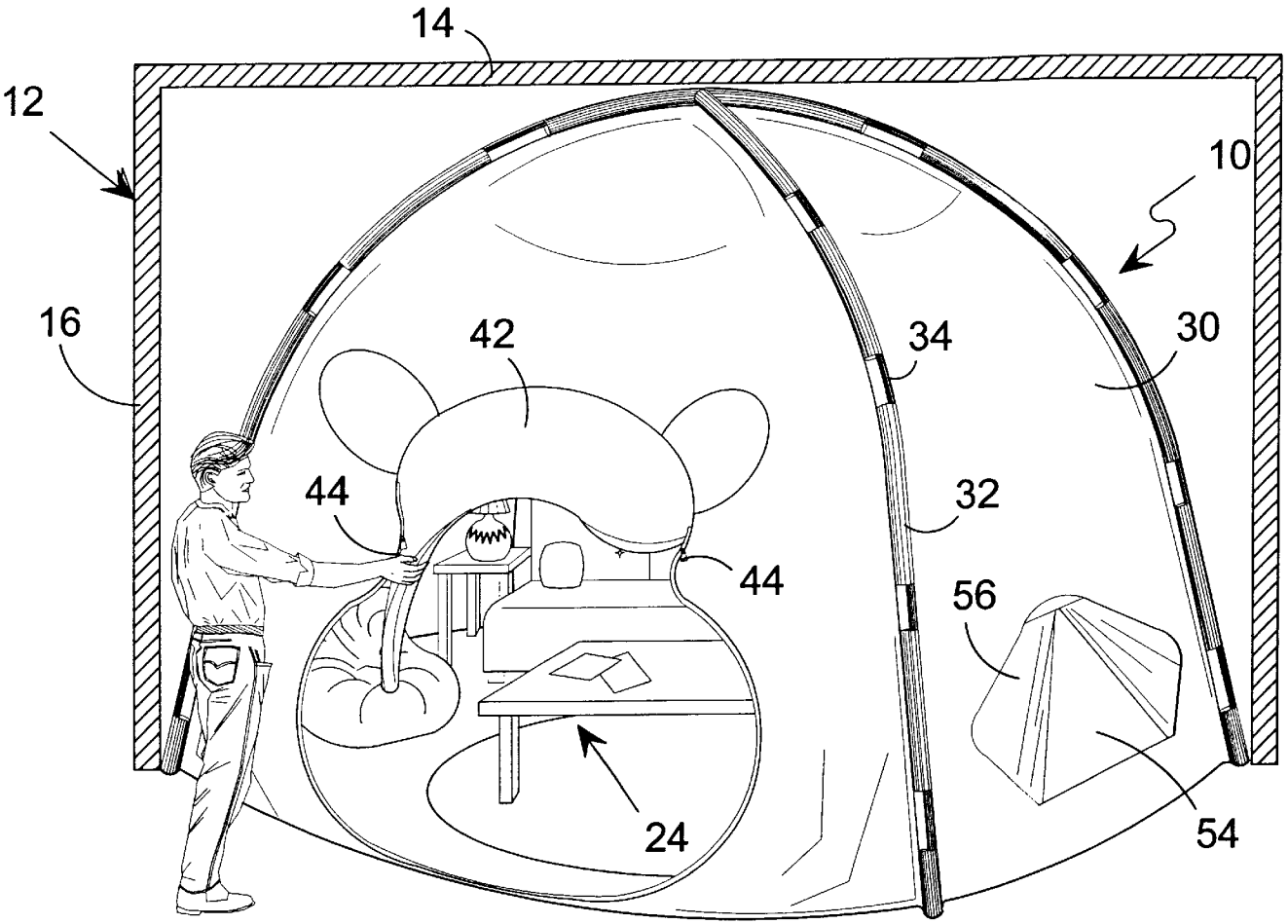
FIG. 3 is an illustrative view of the present invention.

Referring to FIG. 3, shown is an illustrative view of the present invention. The large entrance 42 of the room-tent 10 allows for the moving of large furniture items 24 to be placed within the structure with ease. The room-tent 10 can be set up to meet the needs of the user. Living room or bedroom furnishing 24 may easily furnish the interior of the room-tent 10 for the comfort of the user. The device 10 may be set up within a child's room or used, as a spare room for guests that visit and can provide the privacy sometimes required.

Figure 4:
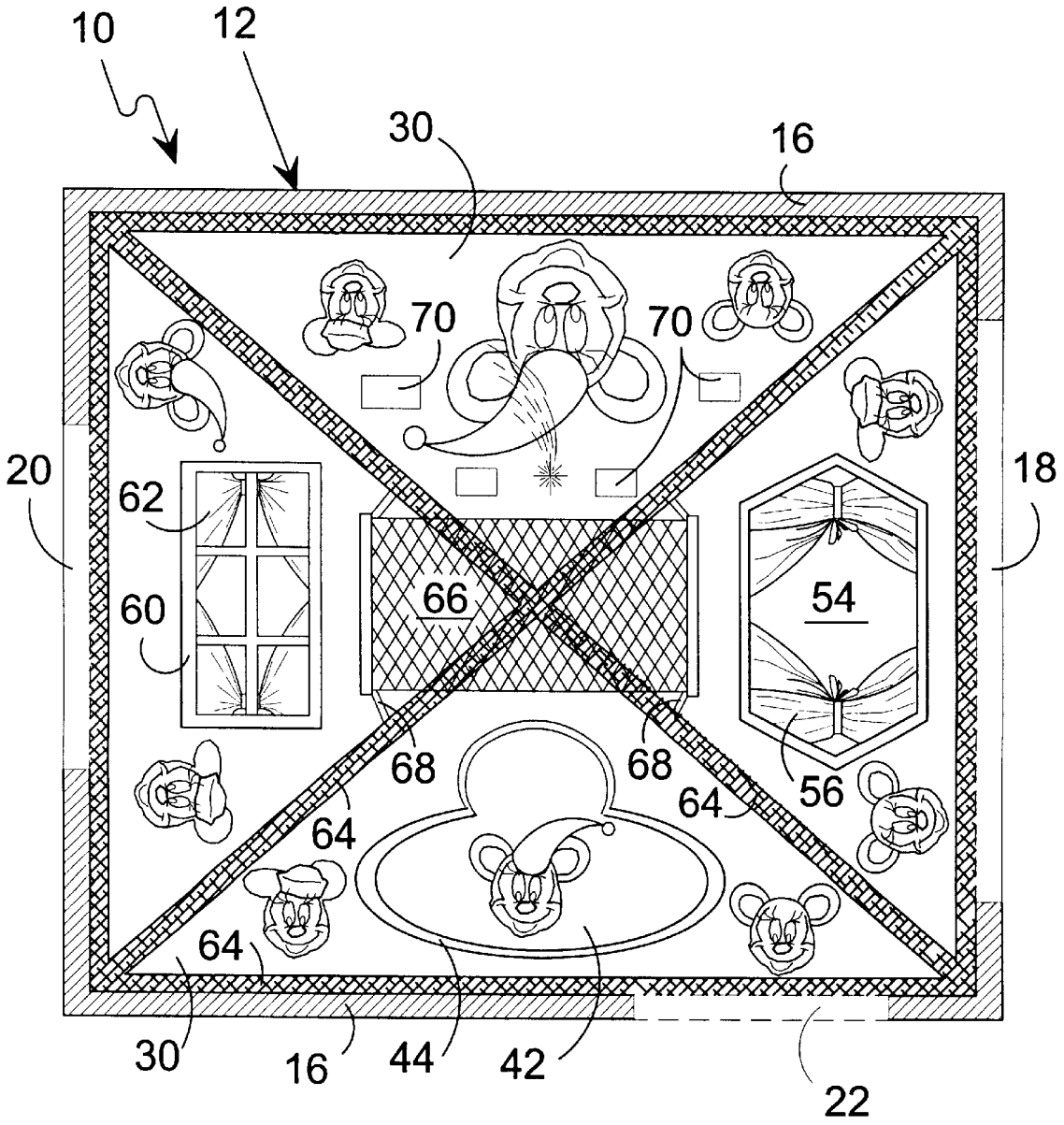
FIG. 4 is a view looking up at the present invention.

Referring to FIG. 4, shown is a view looking up at the present invention. Shown is a view looking up at the room-tent 10 set up within a room. The room tent 10 covers the entire room 12 from all four corners of the ceiling 14 and walls 16 and consists of a four wall tent structure with no floor. A single theme can be preprinted upon the inside walls 30 of the room-tent and can be replaced by other themes to change the mood of the room tent 10. Preprinted panels of any theme can be attached to the hook and loop fasteners 64 located on the inside perimeter of the walls of the room tent 10. Also shown are cargo net 66, cargo net fasteners 68, picture frames 70, window 60, window curtains 62, access port 54 and access port curtains 56.

Figure 5:
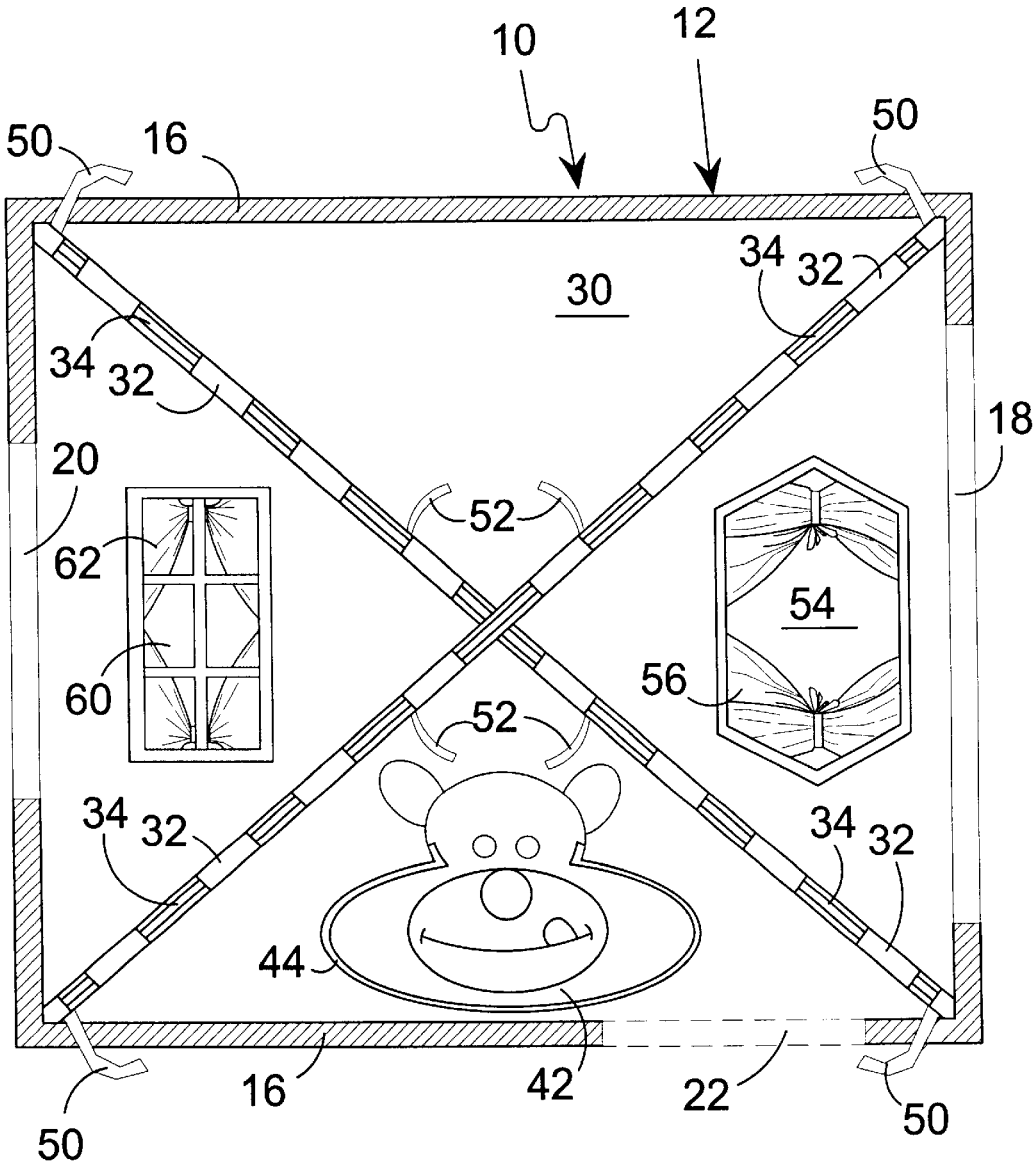
FIG. 5 is a view looking down at the present invention.

Referring to FIG. 5, shown is a view looking down at the present invention. Shown is a view looking down at the room-tent set up within a room 12. The room tent 10 covers the entire room 12 from all four corners of the ceiling 14 and walls 16 and consists of a four wall tent structure with no floor and having a portal opening 18 for access to a closet, view of a fireplace or access to other thing such as a child's toy box, also consisting of a large door 42 with zippers 44, ceiling ribbons 52, corner ribbons 50.

Figure 6:
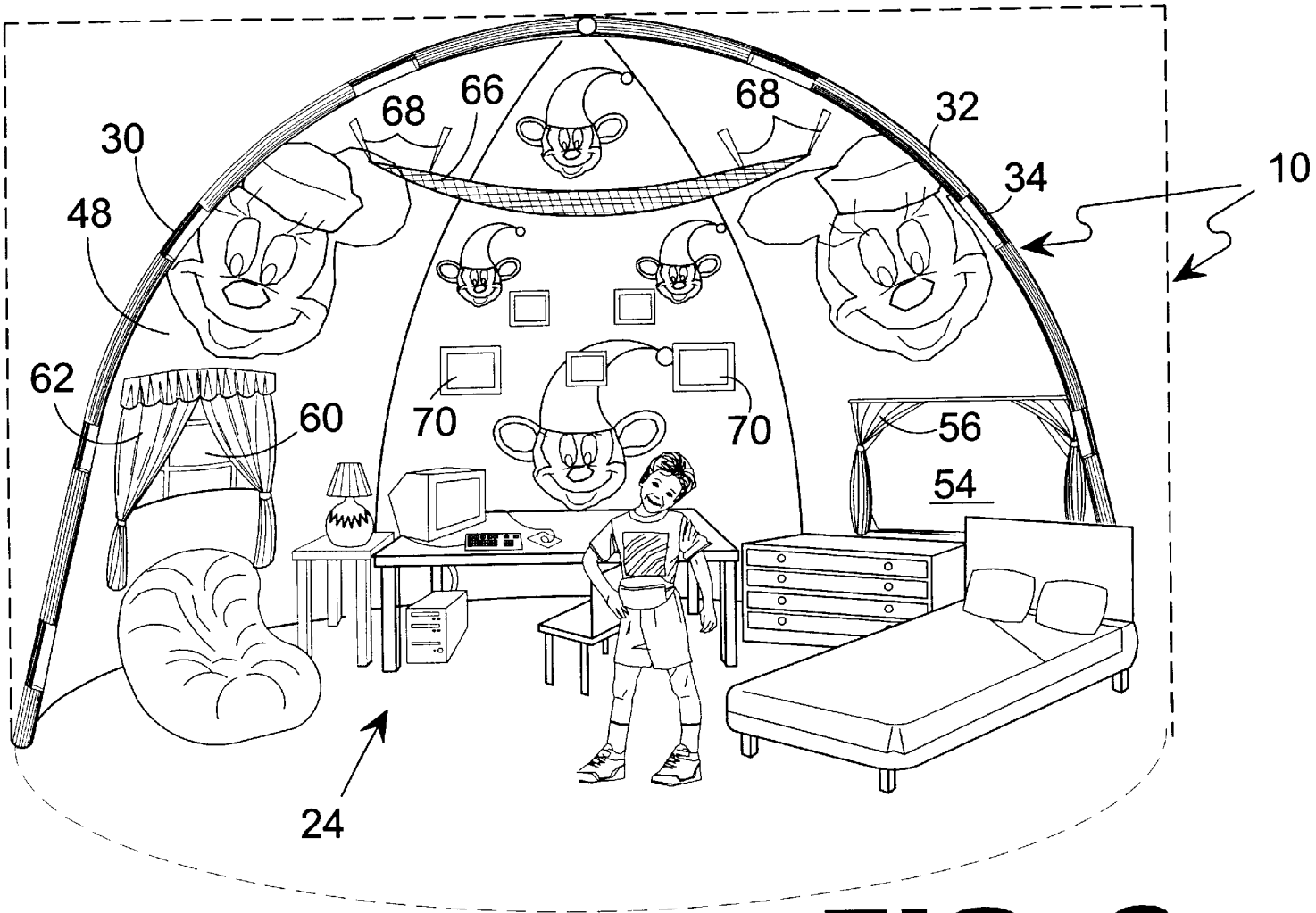
FIG. 6 is an iterior view of a single theme of the present invention.

Referring to FIG. 6, shown is an interior view of a single theme of the present invention. Shown is the interior of the room-tent 10 having a single theme of a Disney character displayed on the interior walls 30. The theme can be changed by overlaying the interior wall 30 with a new theme 48 that is attached using the hook and loop material fasteners 64 positioned along the periphery of the wall section. Also shown are a cargo net 66 suspended from the ceiling of the room-tent 10 by fasteners 68 and hook and loop picture frames 70 hanging from the walls. These items can be used no matter what the arrangement or interior furnishings 24. The picture frames 70 can be changed to meet the decor of the furnishings or preference of the user. They can be changed by fastening other picture frames 70 to the hook and loop material on the interior walls of the room tent 10.

Figure 7:
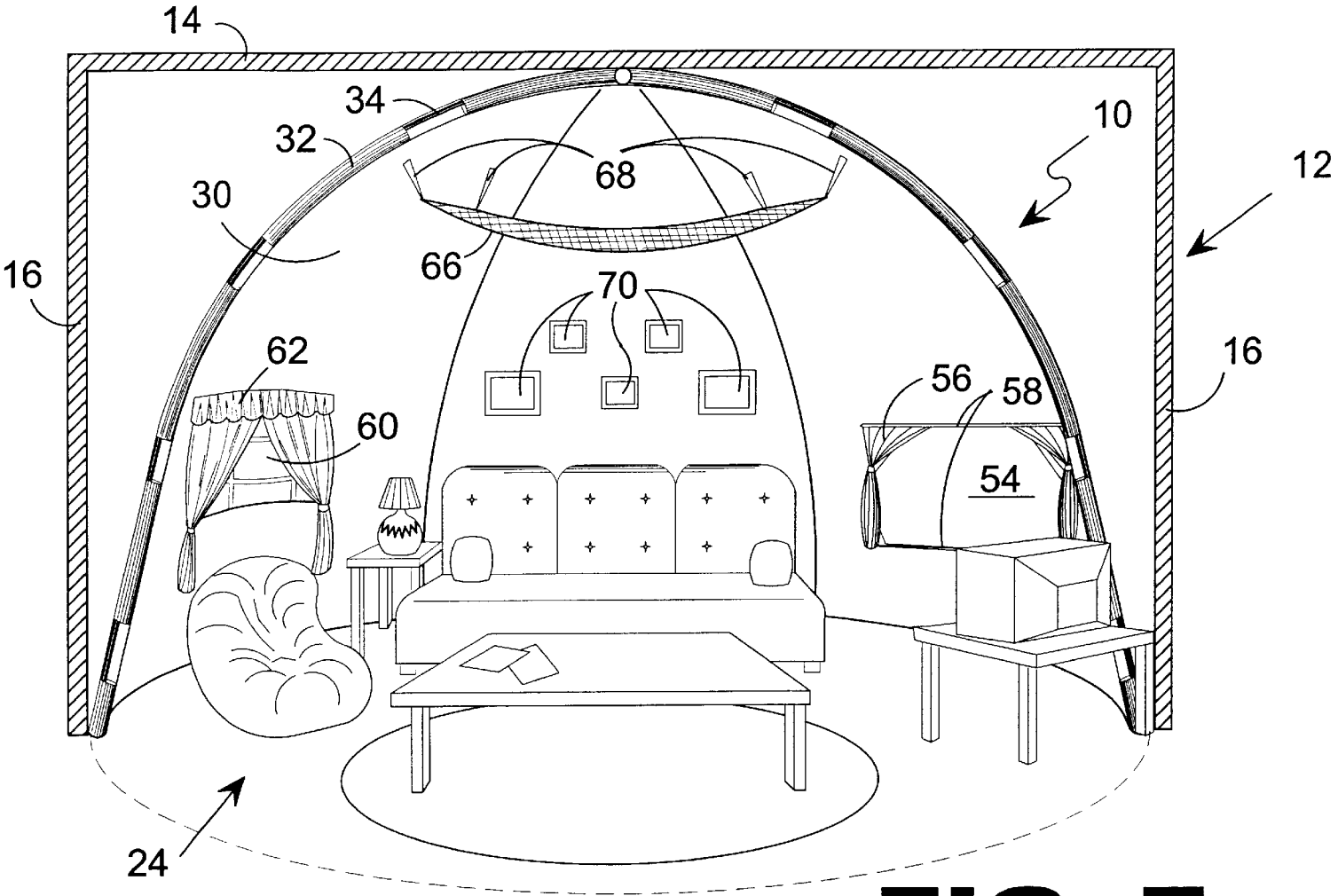
FIG. 7 is a cutaway view of the interior of the present invention.

Referring to FIG. 7, shown is a cutaway view of the interior of the present invention. Shown is a cutaway view depicting the room-tent 10 as a living room setup consisting of a cargo net 66 suspended from the ceiling of the tent and hook and loop picture frames 70 hanging from the walls of the interior portion 30 of the structure. These items can be used no matter what the arrangement or interior furnishings used. The picture frames 70 can be changed to meet the decor of the room tent or preference of the user.

Figure 8:
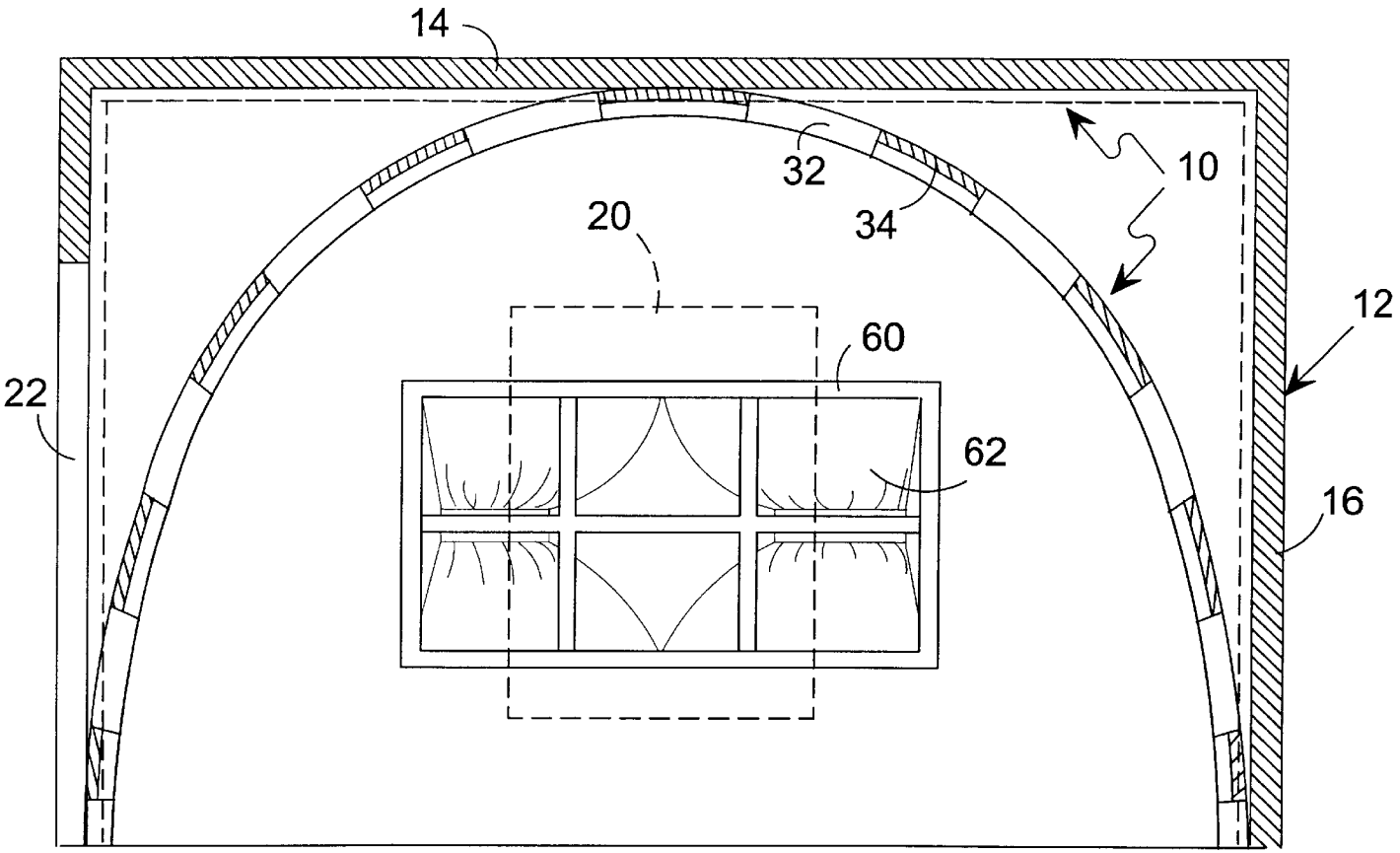
FIG. 8 is a left side view of the present invention.

FIG. 8 is a left side view of the present invention. Shown is a left side view of the room-tent set up within a room 12. The room-tent 10 covers the entire room 12 from all four corners of the ceiling 14 and walls 16 and consists of a four wall tent structure with no floor. The window 60 having curtains 62 of the room-tent 10 can be designed and provided in a vast variety of shapes and sizes and can be positioned over the existing room 12 window 20.

Figure 9:
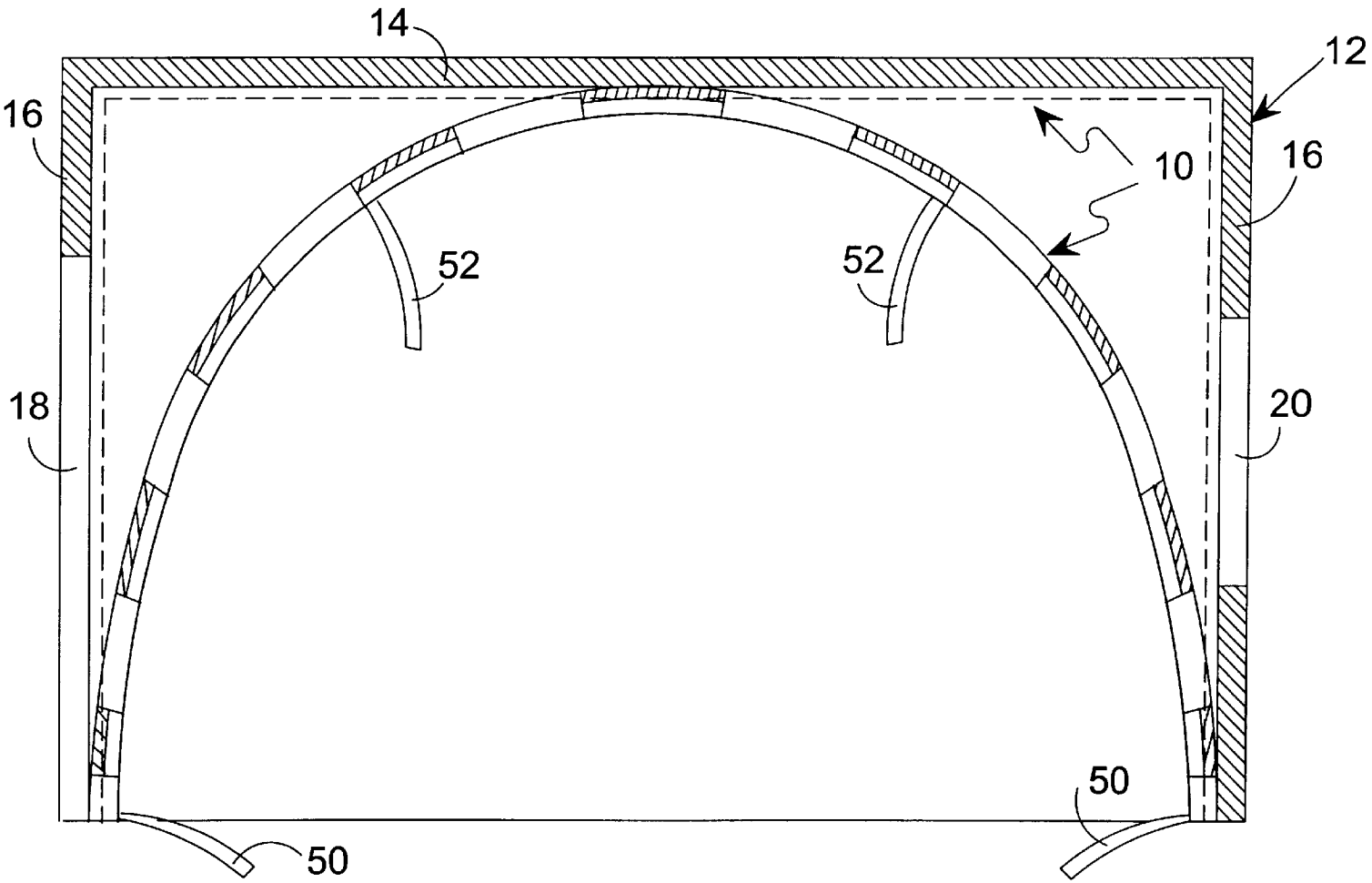
FIG. 9 is a backside view of the present invention.

Referring to FIG. 9, shown is a backside view of the present invention. Shown is a rear view of the room-tent 10 set up within a room 12. The room tent covers the entire room 12 from all four corners of the ceiling 14 and walls 16 and consists of a four wall tent structure with no floor. The ceiling straps 52 and corner straps 50 are used to attach the room-tent 10 to fasteners within a room where the tent is to be setup. Additional windows can be designed for the room tent 10.

Figure 10:
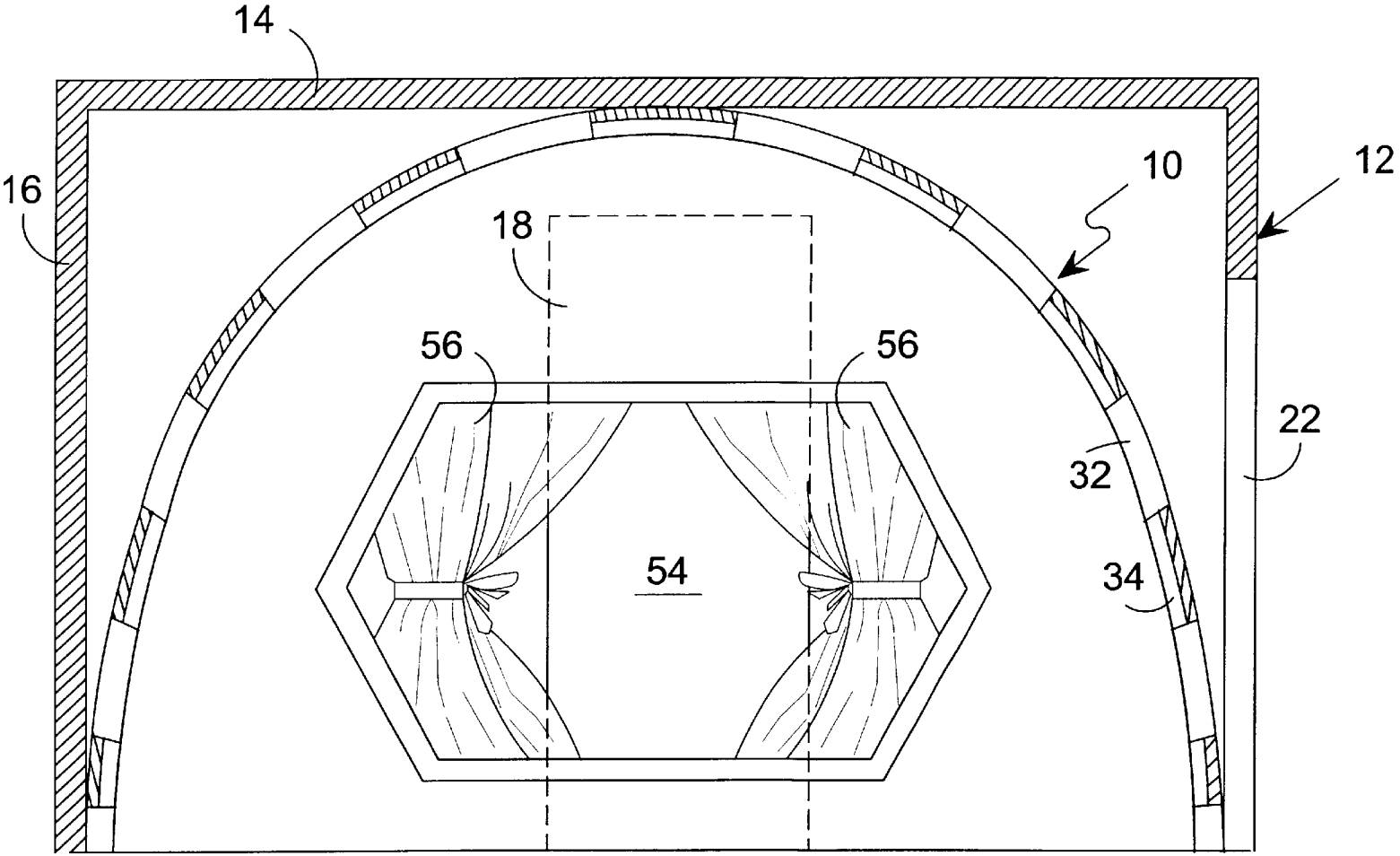
FIG. 10 is right side view of the present invention.

Referring to FIG. 10, shown is a right side view of the present invention. Shown is a right side view of the room-tent 10 set up within a room 12. The room tent covers the entire room 12 from all four corners of the ceiling 14 and walls 16 and consists of a four wall tent structure with no floor and having a portal opening 54 for access to a closet 18, view a fireplace or access to other thing such as a child's toy box.

Figure 11:
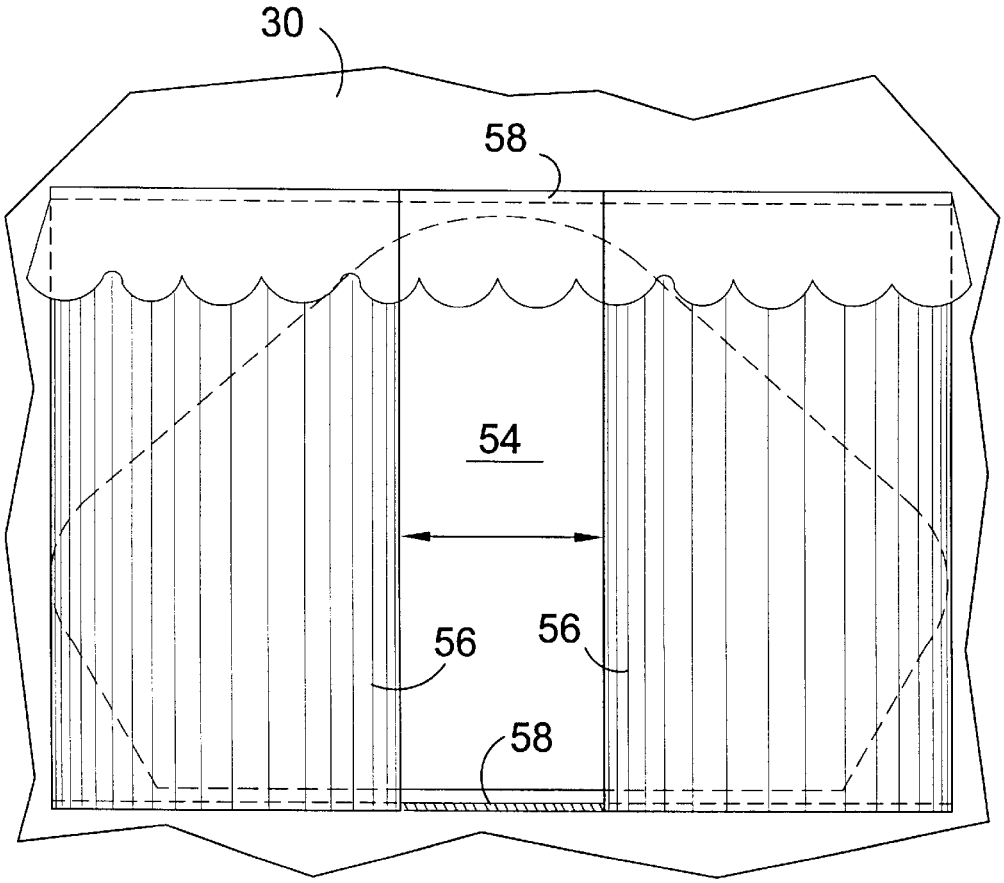
FIG. 11 is a detial view of the present invention.

Referring to FIG. 11, shown is a detail view of the present invention. Shown is a detail view of the portal 54 of the room-tent 10. The portal 54 is designed to face a view of interest such as a fire in a fireplace. It can also allow sun light to enter the interior portion of the room tent 10. The portal 54 also allows air to flow within the structure keeping it cool or warm and preventing the air from becoming stale. Curtains 56 are provided on the interior portion of the portal 54 and can be open or closed by sliding along a rope rail 58 that the curtains ride on. The rope rails 58 are provided at the top and bottom portions of the curtain 56. The rope passes through a hem channel and is attached to the tent structure 30 at both distal ends of the curtain.

Figure 12:
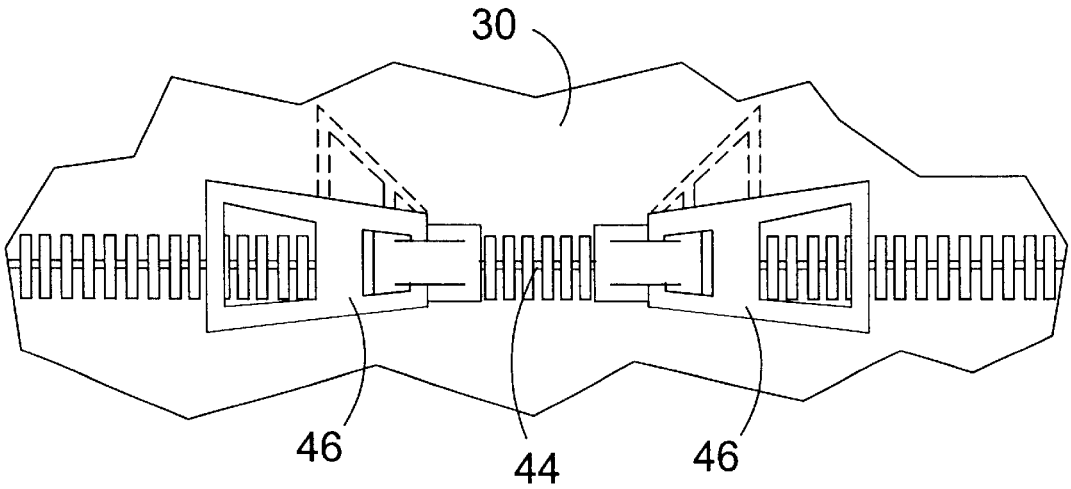
FIG. 12 is an partial view of the present invention.

Referring to FIG. 12, shown is a partial view of the present invention. Shown is a partial view of the entrance zippers 44 having fastener handles 46 of the room-tent 10. The zippers 44 are double sided allowing them to be accessed from the inside as well as the outside. The zippers are located at the bottom center of the entrance flap and open in an upward direction.

Figure 13:
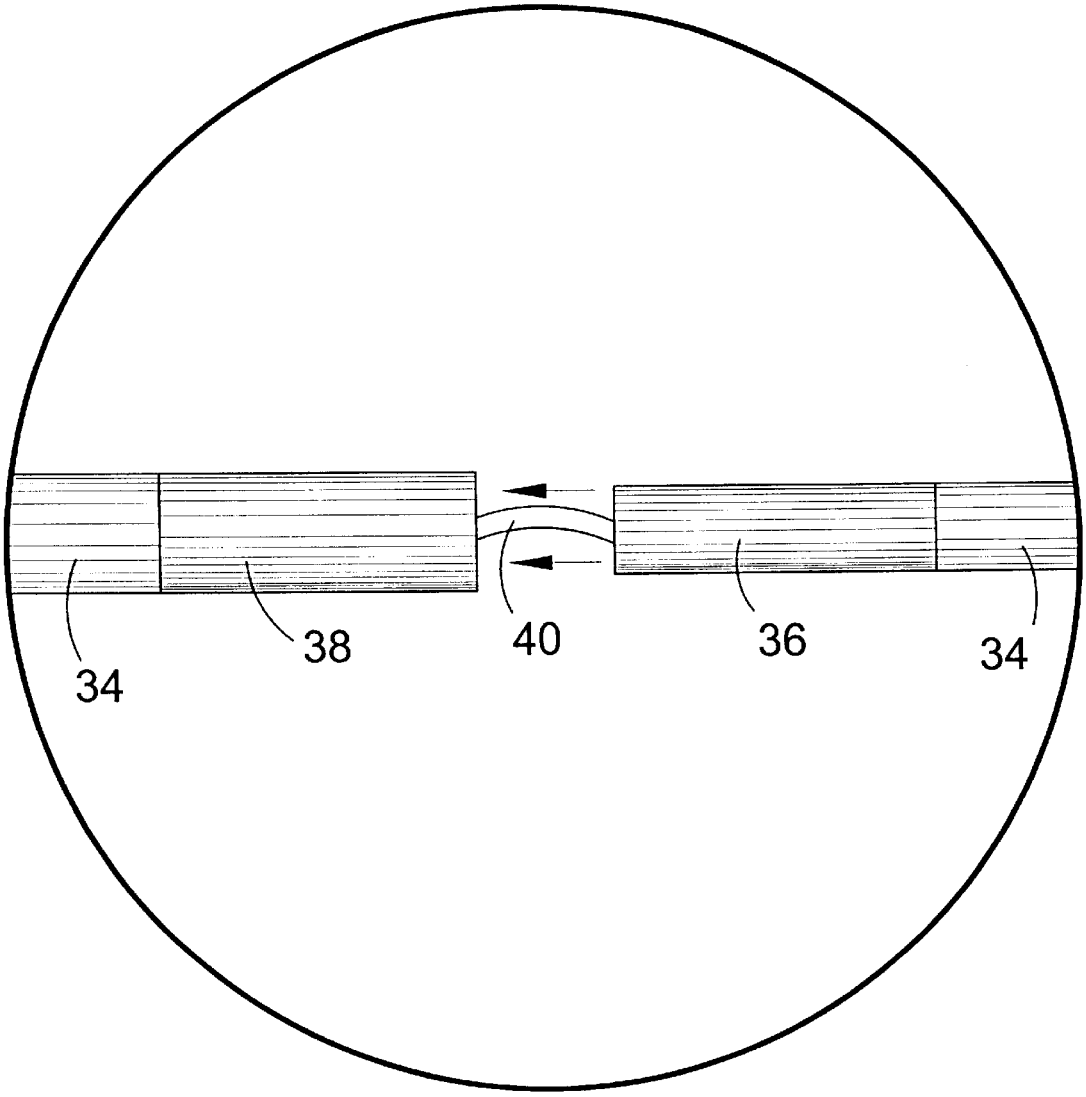
FIG. 13 is an enlarged partial view of the s leeved t ent poles.

Referring to FIG. 13, shown is an enlarged partial view of the sleeved tent poles 34. Shown is a detailed view of the tent pole 34 connection of the present invention. The tent pole system consists of a plurality of pole lengths interconnected by bungee cord 40. The cord pulls against a male side 36 and a female side 38 of the tent pole 34 holding the sleeved members together until selectively separated as for storage.

Referring to FIG. 14, shown is a side view of a picture frame 70 using the hook and loop fasteners 72. Shown is a side view of a detachable picture frame 70 of the room-tent 10. The picture frame 70 consists of a frame structure that accepts an interchangeable picture and has hook and loop fasteners 72. attached to the back portion of the frame. The hook and loop fasteners 72 couple to the mating hook and loop fasteners 72 attached to the tent structure 30.

Referring to FIG. 15, shown is an illustrative view of a tent having a single theme with an additional element. Shown is an interior view of the room-tent 10 having a single Disney character decorating the walls 30. The theme 30 can be changed by fastening wall panels 48 to peripherally positioned hook and loop fasteners 64. Also shown is the invention having an additional element in the form of an inflatable wall bed. The bed is attached to the inside structure and contained behind a flap 76 having fasteners 78.

Referring to FIG. 16, shown is an interior view of the present invention having a single theme and additional element. Shown is a view of the room-tent 10 having a single interior theme with an additional element in the form of an inflatable bed 74 accessible through a panel 76. The bed 74 is attached to the inside structure and hidden behind a flap 76. To remove the bed, four snaps are unfastened and flap laid down. An activation ring is pulled and the bed inflates. To deflate the bed, a deflation plug is removed and air is released.

Referring to FIG. 17, shown is an interior view of the present invention having a single theme and an additional element. Shown is a view of the room-tent 10 having a single theme of a Disney character on the interior walls of the present invention. Also shown is an additional element in the form of an inflatable bed 74. To remove the bed, four snaps are unfastened and flap laid down. An inflation valve 80 is used to inflate the bed. To deflate the bed, a deflation valve 82 is removed and air is released.

What is claimed is new and desired to be protected by Letters Patent is set forth in the appended claims:

1. A room-tent that substantially encompasses the space within, and in combination with, a room designed to change the atmosphere within a child's room or play room comprisng:

a) pliable fabric walls forming a domc-shaped room-tent with a top of said room-tent in contact with a ceiling of said room and a floor of said room providing a floor for interior space of said room-tent, said fabric walls conformin substantially to height and breadth of walls of said room;

b) a zippered access panel in said fabric walls forming a door;

c) a first aperture providing access to an cxterior of said room-tent;

d) a second apcrture forming a window aligned with a window in said room;

e) straps fixedly attached Io an exterior surface of said room-tent for releasably suspending the room-tent from room ceiling fasteners; and f) straps fixedly attached to a base of said room-tent for releasably fasening thc room-tent to floor level fasteners.

2. The room-tcnt as recited in claim 1, whereby appliance cords pass under walls of the room-tent along the floor of said room to existing room electrial receptacles.

3. The room-tcnt as recited in claim 1, wherein interior walls of said room-tent are preprinted with a pattern forming a decorative theme.

4. The roomn-tent as recited in claim 1, wherein interior walls of said room-tent are pigmented a solid color forming a decorative theme.

5. The room-tcnt as recited in claim 1, wherein the room-tent has exteriorly positioned channels forming an integral part of said room-tent, said channels having tent poles passing therethrough.

6. The roortent as recited in claim 5, wherein the tent poles are comprisedof a plurality of sections each having a male and fermale distal end whereby said sections can be connected end to end.

7. The room-tent as recited in claim 6, wherein the tent poles have a throughbore wherein an elasticlikc retaining member extends from one distal end to the other providing means for easily dismantling and storing the room-tent.

8. The room-tent as recited in claim 1, flilrier comprising a cargo net suspended inside said room-tent below a top of said dome by a plurality of fixedly positioned straps.

9. The room-tent as recited in claim 1, funher comprising hook and loop material fastened to inside the walls of said room-tent whereby picture frames having mating hook and loop material can be releasably attached thereto.

10. The room-tent as recited in claim 1, further comprising an interiorly positioned inflatable bed.

11. The roon-tent as recited in claim 10, wherein said inflatable bed is concealed behind an interiorly positioned access panel having releasable fasteners affixed thereto.

12. A room-tent that substantially emnc passes the space within, and in combination with, a room comprising:

a) a four wall tent structure with pliable fabric walls covering all four corners and walls of said room with a floor of said room forming a floor for said tent structure and a portal opening aligned with a closet or fireplace of said room;

b) a zippered access panel forming a door in said tent strucre c) preprinted panels forming a theme attached with hook and loop fasteners on an inside perimeter of said fabnc walls; and d) a cargo net suspended within said tent structure adjacent a ceiling of said tent structure.

* * * * *